US007703949B2

(12) United States Patent
Lai

(10) Patent No.: US 7,703,949 B2
(45) Date of Patent: Apr. 27, 2010

(54) LED ILLUMINATING DEVICE WITH LED CHIP

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 265 days.

(21) Appl. No.: 12/073,090

(22) Filed: Feb. 29, 2008

(65) Prior Publication Data

US 2009/0067171 A1 Mar. 12, 2009

(30) Foreign Application Priority Data

Sep. 10, 2007 (TW) ..... 96215181 U

(51) Int. Cl.
*F21V 29/00* (2006.01)

(52) U.S. Cl. ..... 362/294; 362/218; 362/249.02; 362/373; 362/800

(58) Field of Classification Search ..... 362/218, 362/294, 249.02, 373, 800
See application file for complete search history.

(56) References Cited

U.S. PATENT DOCUMENTS 5,173,839 A 12/1992 Metz, Jr.
5,890,794 A * 4/1999 Abtahi et al. ..... 362/294
6,220,722 B1 * 4/2001 Begemann ..... 362/231
6,525,668 B1 * 2/2003 Petrick ..... 340/815.45
6,634,770 B2 * 10/2003 Cao ..... 362/294
7,086,767 B2 * 8/2006 Sidwell et al. ..... 362/545
7,150,553 B2 * 12/2006 English et al. ..... 362/545
7,637,636 B2 * 12/2009 Zheng et al. ..... 362/294
2006/0098449 A1 5/2006 Bariller et al.
2007/0047231 A1 * 3/2007 Tain ..... 362/294
2007/0159828 A1 * 7/2007 Wang ..... 362/294

* cited by examiner

*Primary Examiner*—Stephen F Husar
*Assistant Examiner*—James W Cranson
(74) *Attorney, Agent, or Firm*—Bacon & Thomas, PLLC

(57) ABSTRACT

An LED illuminating device includes a column-shaped thermally conductive member having a taper-shaped portion at a front end thereof and being electrically conductive; a first insulating layer partially covered on the taper-shaped portion; a taper-shaped member sleeved onto the first insulating layer, covered above the taper-shaped portion, and spaced from the taper-shaped portion by the first insulating layer having a plurality of through holes and being electrically conductive; and a plurality of LED units mounted to the taper-shaped portion, passing through the through holes respectively, and exposed outside the taper-shaped member. Each of the LED units includes at least one LED chip having two electrodes electrically connected with the thermally conductive member and the taper-shaped member respectively. Therefore, the LED illuminating device has preferable efficiency of thermal dissipation for LEDs and provides larger area for mounting LED units thereto.

6 Claims, 7 Drawing Sheets

LED ILLUMINATING DEVICE WITH LED CHIP

BACKGROUND OF THE INVENTION

1. Field of the Invention

The present invention relates generally to light emitting diodes (LEDs), and more particularly, to an LED illuminating device.

2. Description of the Related Art

While a conventional high-power LED is working, it generates high heat. However, none of any better solution to improvement of the dissipation of such heat has been proposed. Particularly, the illuminating device based on such high-power LED will fail to be applied to the daily life of people if the dissipation of the high heat cannot be effectively improved.

U.S. Pat. No. 5,173,839 disclosed a heat-dissipating method of an LED display, in which the LED chip is composed of a thermally conductive tape, an aluminum strip, and a heat sink. The heat generated by the LED chip is partially transmitted outside from a lower side of the LED chip. However, three medium layers are located between the LED chip and the heat sink where the other primary part of the heat is generated, such that the number of the medium layers is so big that the thermal resistance is greater to incur worse efficiency of thermal dissipation.

Further, as disclosed in U.S. Patent Laid-Open No 2006/0098449, an LED is mounted on a flat portion of one end of a heat pipe, and however the flat portion has limited area, such that only few LEDs can be mounted on the flat portion. As known from the drawings, the LED is mounted onto the heat pipe via a base, or a plurality of LEDs are mounted on the same heat pipe via the same base. However, the thermal resistance will still be high if the base is used as the medium layer for thermal conduction. Although it takes advantage of the isothermal performance of the heat pipe for good thermal dissipation, only the flat surface of one end of the heat pipe is available for mounting the LEDs thereto, so the number and the position of the LEDs are restricted. When this heat-dissipating method is applied to the illuminating device, the thermal dissipation of the illuminating device is not effective, so that the range of its application is small and there is some space for improvement. In addition to the method, even if the heat pipe is also applied to the illuminating device, because a very thick base is still located between the LEDs and the heat pipe, under the condition of high thermal resistance, the enhancement of efficiency of the thermal dissipation is still limited. Further, the area of the LEDs is also limited because the heat pipe is mounted to the LEDs.

SUMMARY OF THE INVENTION

The primary objective of the present invention is to provide an LED illuminating device, which provides preferable efficiency of thermal dissipation for LEDs.

The secondary objective of the present invention is to provide an LED illuminating device, which provides larger area for mounting LED units thereto.

The foregoing objectives of the present invention are attained by the LED illuminating device, which is composed of a column-shaped thermally conductive member, a first insulating layer, a taper-shaped member, and a plurality of LED units. The thermally conductive member includes a taper-shaped portion at a front end thereof, being electrically conductive. The first insulating layer is partially covered on the taper-shaped portion. The taper-shaped member is sleeved onto the first insulating layer and covered above the taper-shaped portion, spaced from the taper-shaped portion by the first insulating layer. The taper-shaped member includes a plurality of through holes, being electrically conductive. The LED units are mounted to the taper-shaped portion, passing through the through holes respectively and exposed outside the taper-shaped member. Each of the LED units includes at least one LED chip having two electrodes, one of which is electrically connected with the thermally conductive member and the other is electrically connected with the taper-shaped member.

DETAILED DESCRIPTION OF PREFERRED EMBODIMENTS

Figure 1:
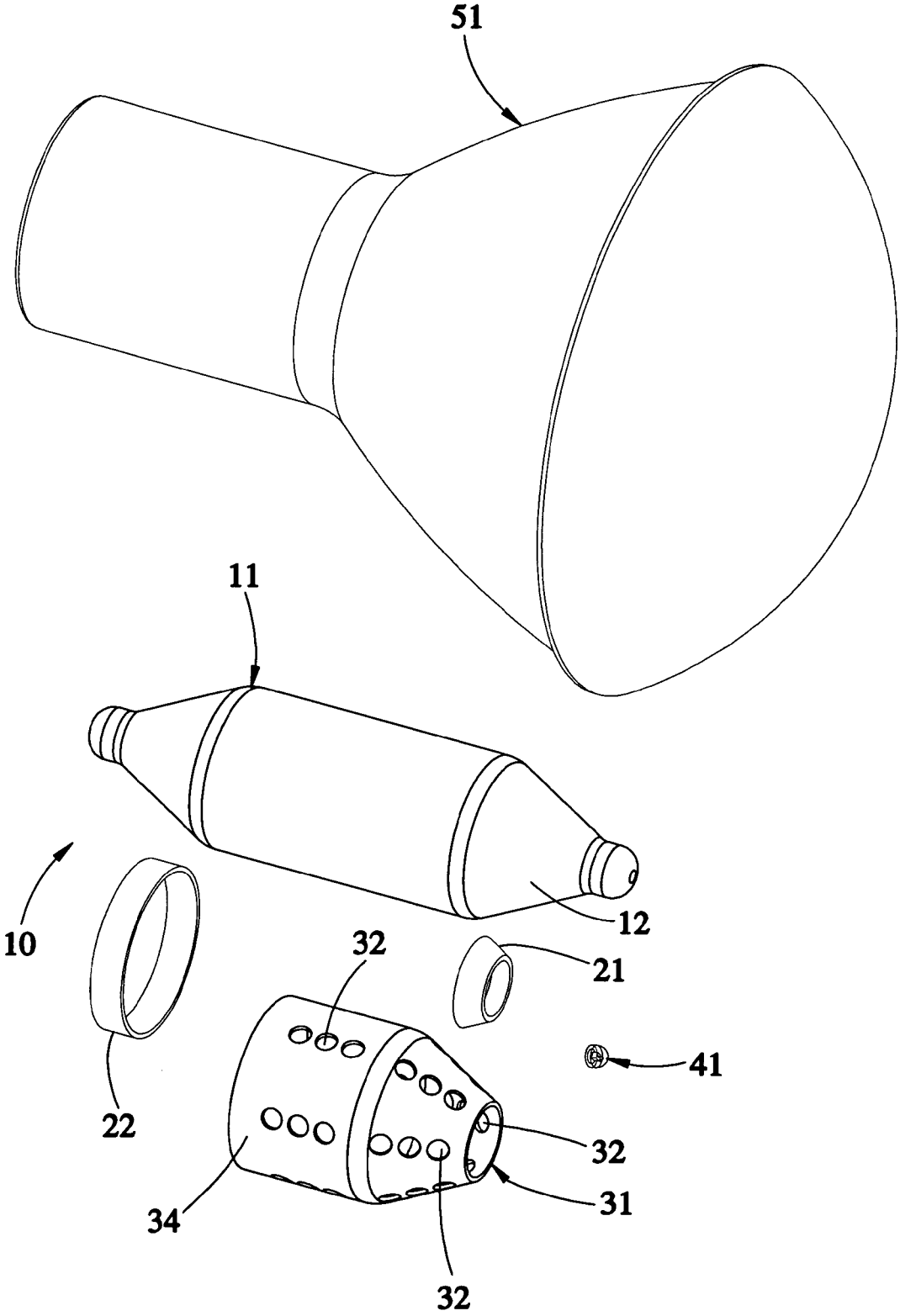
FIG. 1 is an exploded view of a first preferred embodiment of the present invention.
Figure 2:
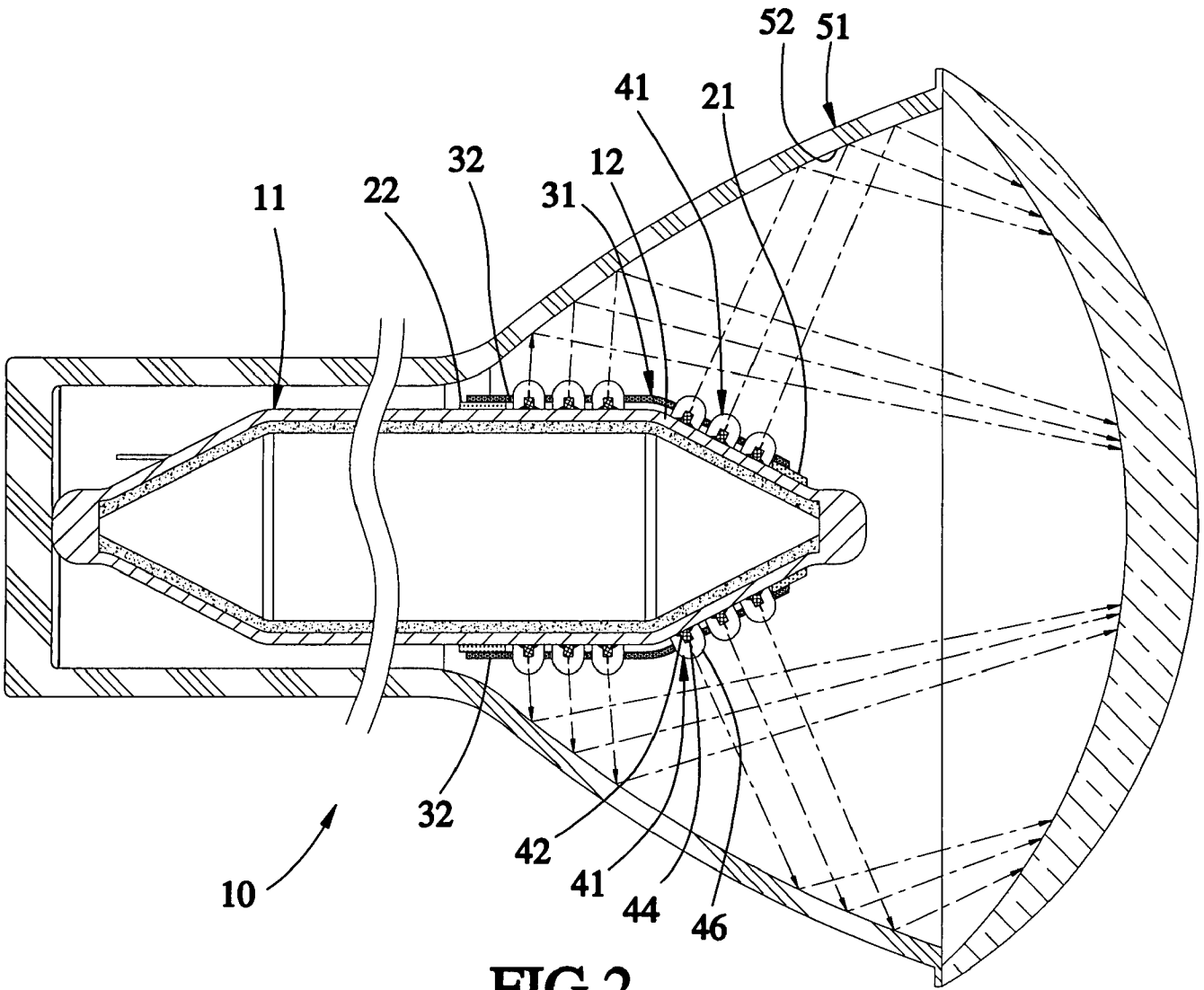
FIG. 2 is a sectional view of the first preferred embodiment of the present invention.
Figure 3:
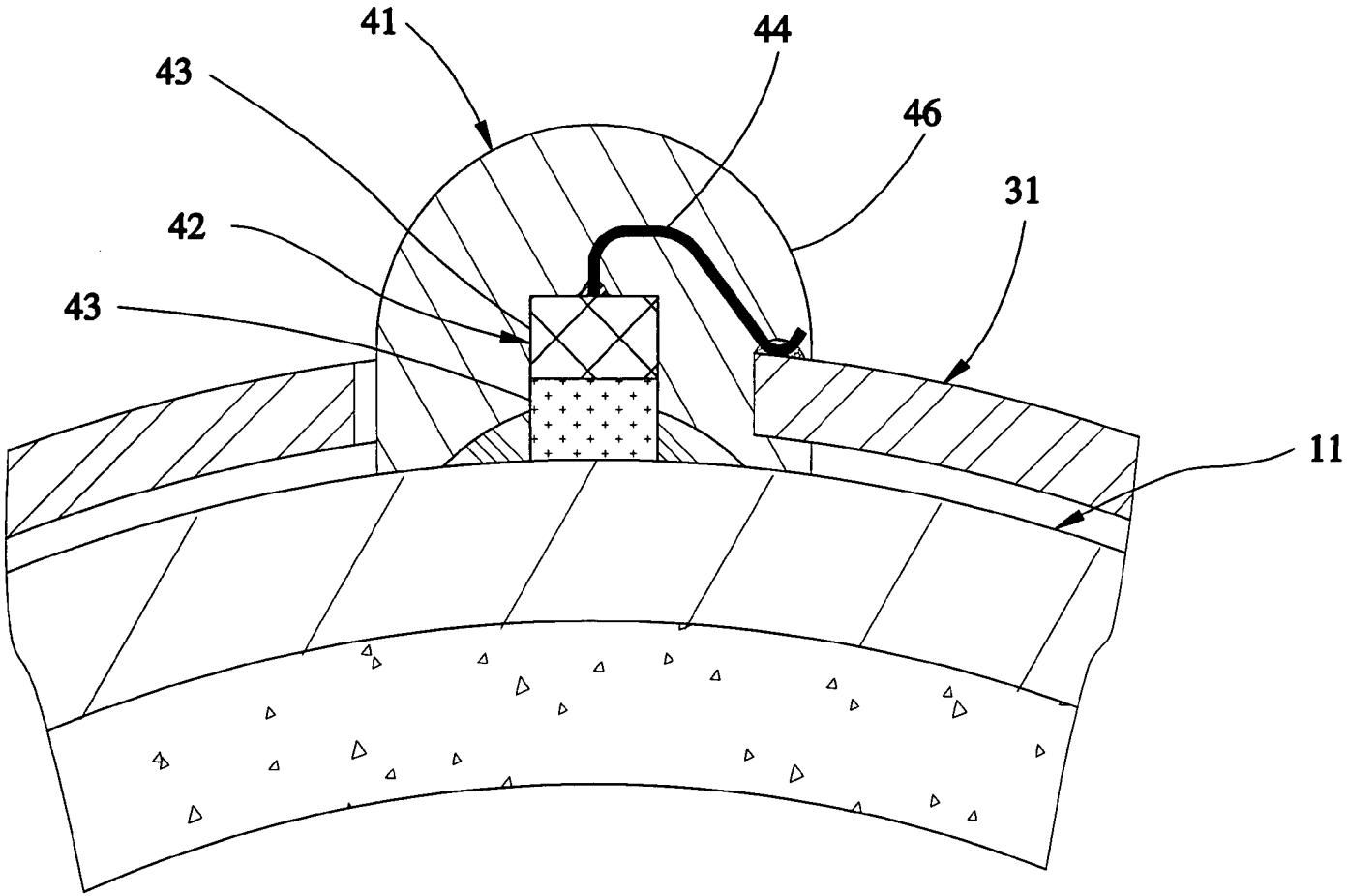
FIG. 3 is an enlarged sectional view of a part of the first preferred embodiment of the present invention, illustrating how the LED units are disposed.
Figure 4:
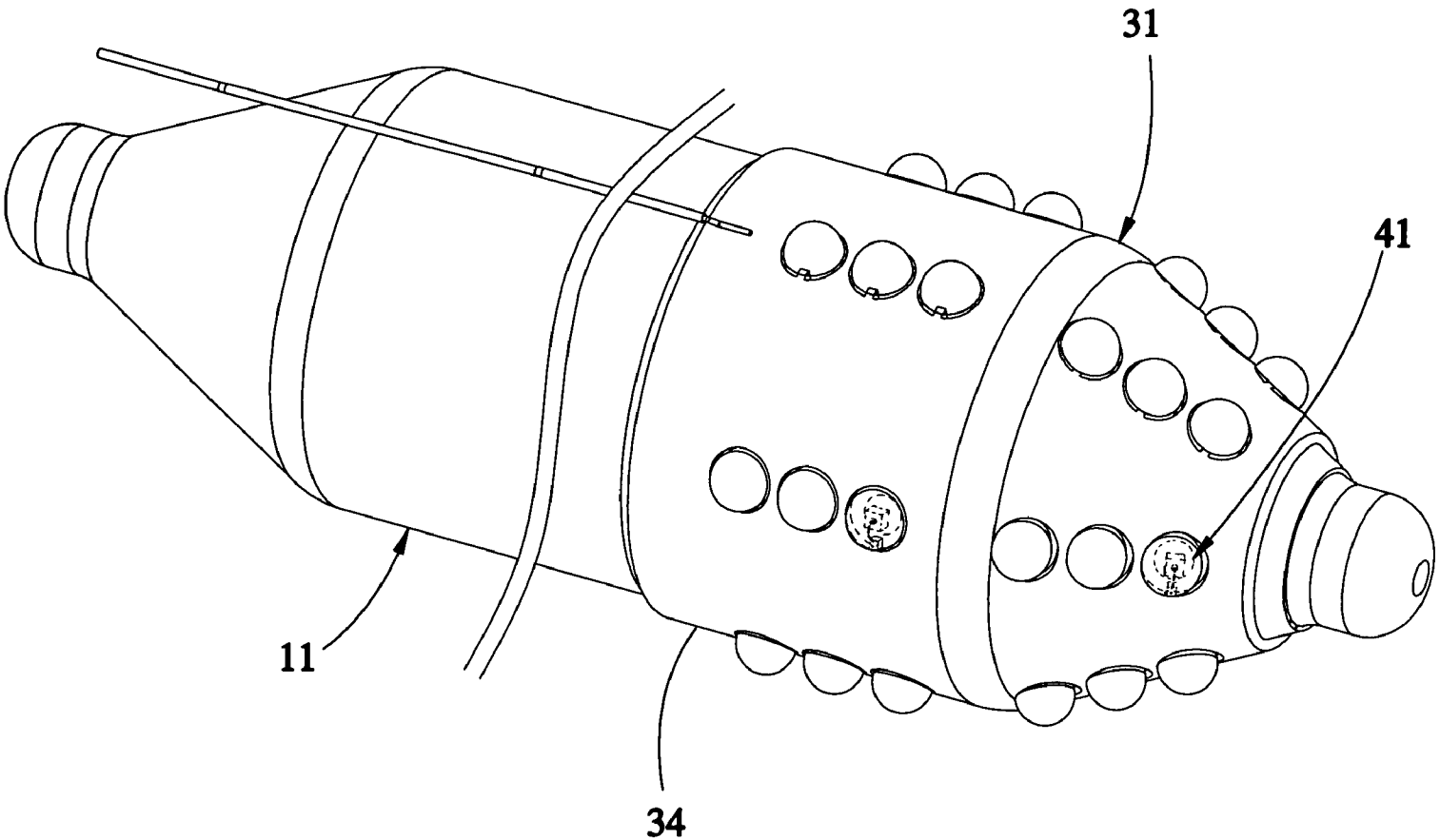
FIG. 4 is a perspective view of a part of the first preferred embodiment of the present invention.
Figure 5:
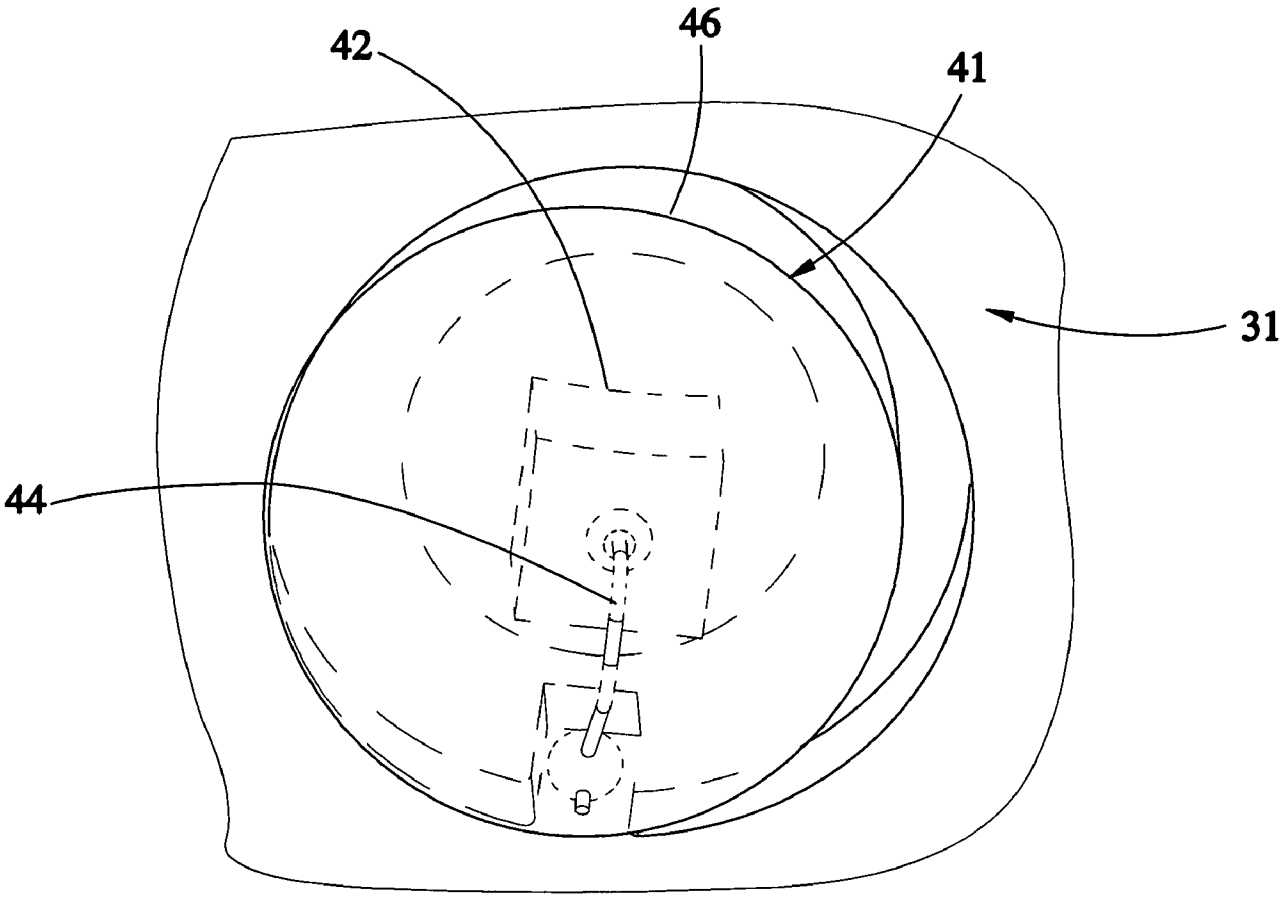
FIG. 5 is an enlarged schematic view of a part of the first preferred embodiment of the present invention, illustrating the structure of one LED unit.

Referring to FIGS. 1-5, an LED illuminating device 10 constructed according to a first preferred embodiment of the present invention is composed of a thermally conductive member 11, a first insulating layer 21, a second insulating layer 22, a taper-shaped member 31, a plurality of LED units 41, and a reflective cup 51.

The thermally conductive member 11 is a heat sink in this embodiment, such as heat pipe, including a taper-shaped portion 12 at a front end thereof. The thermally conductive member 11 is column-shaped and electrically conductive.

The first insulating layer 21 is partially covered on the taper-shaped portion 12, being annular in shape and covering a front part of the taper-shaped portion 12.

The second insulating layer 22 is partially covered on a midsection of the thermally conductive member 11.

The taper-shaped member 31 is sleeved onto the first insulating layer 21 and covered on the taper-shaped portion 12, spaced from the taper-shaped portion 12 by the first insulating layer 21. The taper-shaped member 31 is electrically conductive, including a plurality of through holes 32 running therethrough, and an extension body 34 surrounding the midsection of the thermally conductive member 11 and sleeved onto the second insulating layer 22. In light of this, the taper-shaped member 31 and the extension body 34 are spaced from the thermally conductive member 11 by the first and second insulating layers 21 and 22.

The LED units 41 are mounted onto the taper-shaped portion 12 and the midsection of the thermally conductive member 11, passing through the through holes 32 and then exposed outside the taper-shaped member 31. Each of the LED units 31 includes an LED chip 42, a lead wire 44, and a packaging member 46. The LED chip 42 has two electrodes 43, one of which is planted onto a surface of the thermally conductive member 11 to be electrically conducted with the thermally conductive member 11 and the other is electrically connected with the taper-shaped member 31 via the lead wire 44. The packaging member 46 encases the lead wire 44 and the LED chip 42.

The reflective cup 51 is sleeved onto the thermally conductive member 11, having a reflective surface 52 at an internal side thereof and corresponding to the LED units 41.

In light of the above structure, blocked by the first and second insulating layers 21 and 22, none of any electric conduction, i.e. short circuit, will happen between the taper-shaped member 31 and the thermally conductive member 11. Because the two electrodes 43 of each LED unit 41 are electrically connected with the taper-shaped member 31 and the thermally conductive member 11 respectively, while the taper-shaped member 31 and the thermally conductive member 11 are electrified with positive and negative charges respectively, the LED units 41 light up. By means of the reflectivity of the reflective cup 51, the light of the LED units 41 can be reflected via the reflective cup 51 to a predetermined area and then the rays of the light can converge to irradiate outward for more brightness.

In addition, the LED chips 42 are directly planted onto the thermally conductive member 11, such that their heat is directly transmitted to the thermally conductive member 11 and then the thermally conductive member 11 can transmit the heat outward. Therefore, the LED units 41 can have preferable thermal dissipation.

Figure 6:
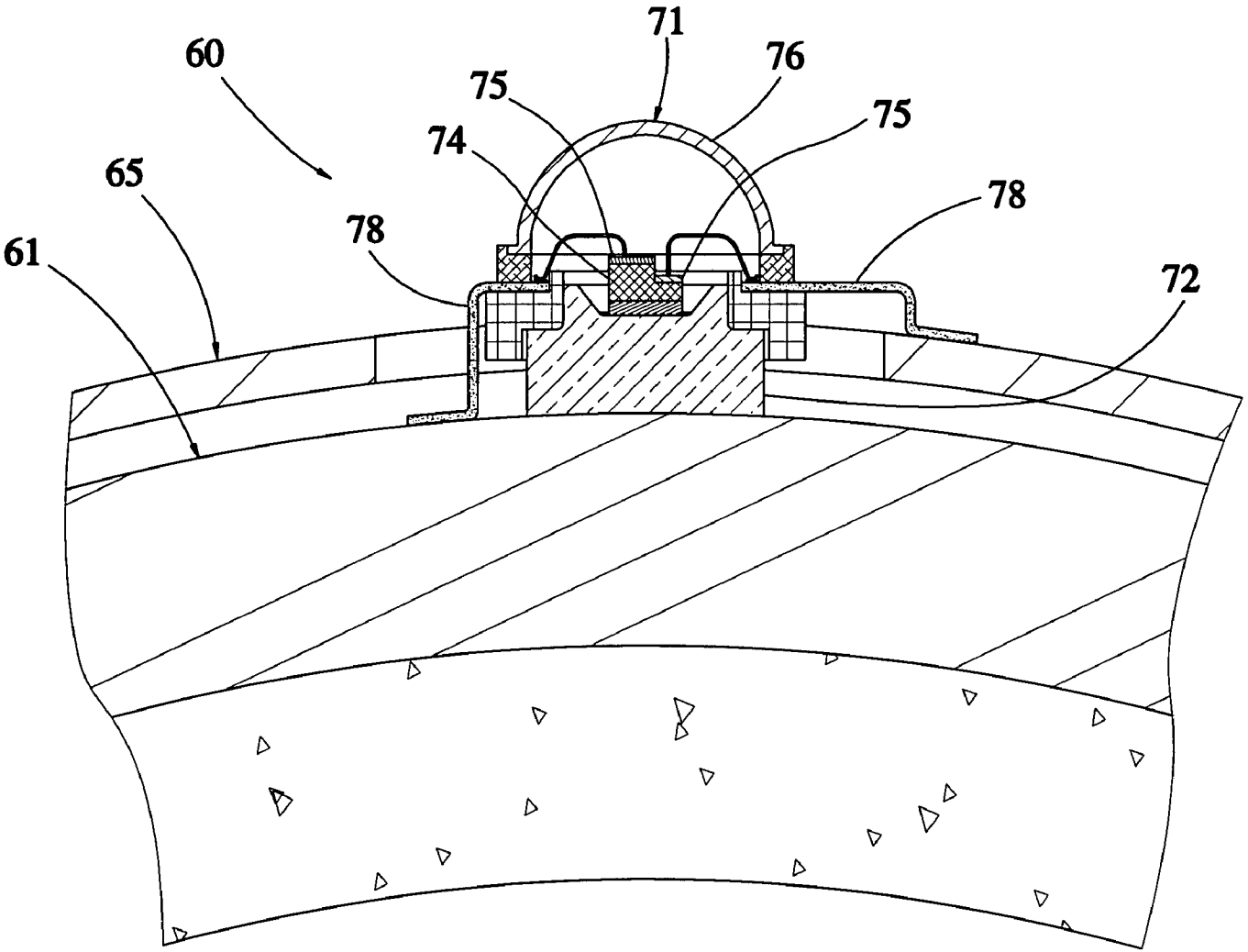
FIG. 6 is an enlarged sectional view of a part of a second preferred embodiment of the present invention.

Referring to FIG. 6, an LED illuminating device 60 constructed according to a second preferred embodiment of the present invention is similar to the first embodiment, having difference as recited below.

Each of the LED units 71 is composed of an insulating thermally-conductive base 72, an LED chip 74, a packaging member 76, and two electrically conductive pieces 78. The LED chip 74 is mounted onto the insulating thermally-conductive base 72. The insulating thermally-conductive base 72 is planted onto the surface of the thermally member 61. The packaging member 76 encases the LED chip 74 and the insulating thermally-conductive base 72. The two electrically conductive pieces 78 are electrically connected with the two electrodes 75 of the LED chip 74 respectively. The two electrically conductive pieces 78 are also electrically connected with the thermally conductive member 61 and the taper-shaped member 65.

The heat generated by each of the LED chips 74 in the second embodiment is transmitted through the insulating thermally-conductive base 72 to the thermally conductive member 61. The structure of the LED unit 71 is the primary difference of the second embodiment from the first one and the other components of the LED illuminating device 60 and the effects achieved thereby are identical to those of the LED illuminating device 10, so no more recitation is necessary.

Figure 7:
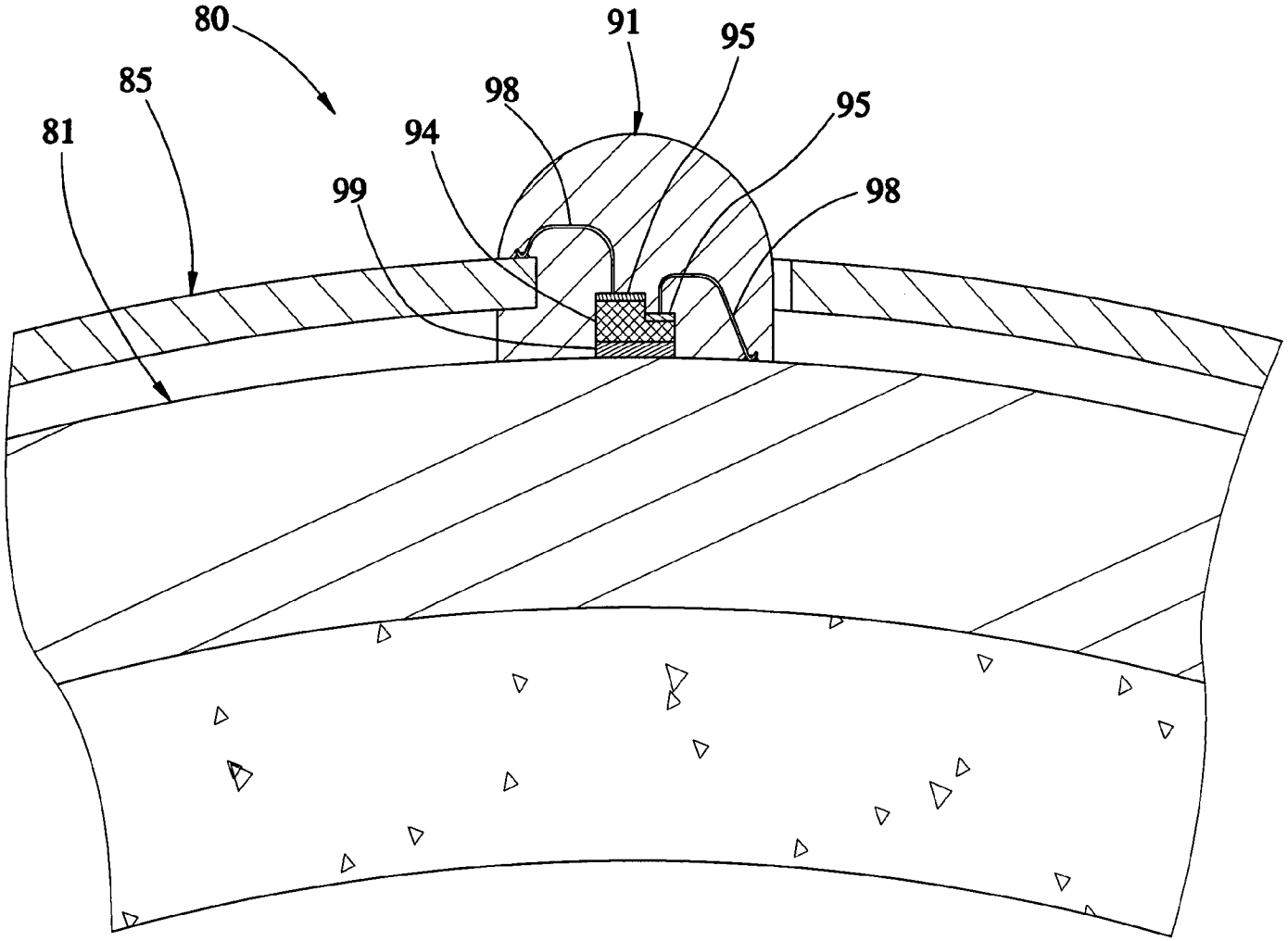
FIG. 7 is an enlarged sectional view of a part of a third preferred embodiment of the present invention.

Referring to FIG. 7, an LED illuminating device 80 constructed according to a third preferred embodiment of the present invention is similar to the second embodiment, having difference as recited below.

Each of the LED chips 94 of the LED units 91 includes two electrodes 95 at a surface thereof and an insulating layer 99 at a bottom side thereof. One of the two electrodes 95 is electrically connected with the thermally conductive member 81 via a wire 98, and the other is electrically connected with the taper-shaped member 85 via a wire 98. Each of the insulating layers 99 is planted onto the surface of the thermally conductive member 81.

The structure of the LED unit 91 is the primary difference of the third embodiment from the second one and the other components of the LED illuminating device 91 and the effects achieved thereby are identical to those of the LED illuminating device 60, so no more recitation is necessary.

In conclusion, the present invention can achieve the effects as follows. The heat of the LED chips can be directly transmitted to the thermally conductive member, i.e. the heat pipe or the heat sink, without any medium layer, or through the insulating thermally-conductive base located beneath the LED chip. In addition, the taper-shaped portion provides larger area for mounting the LED units thereon, and the light of the LED chips can directly irradiate outward or be emitted to the reflective cup and then reflected outward to further be converged for enhancement of the brightness.

Although the present invention has been described with respect to specific preferred embodiments thereof, it is no way limited to the details of the illustrated structures but changes and modifications may be made within the scope of the appended claims.

What is claimed is:

1. An LED illuminating device comprising:

a column-shaped thermally conductive member having a taper-shaped portion at a front end thereof and being electrically conductive;

a first insulating layer partially covering said taper-shaped portion;

a taper-shaped member sleeved onto said first insulating layer and covering said taper-shaped portion and spaced from said taper-shaped portion by said first insulating layer, said taper-shaped member having a plurality of through holes and being electrically conductive; and a plurality of LED units mounted onto said taper-shaped portion and passing through said through holes to be exposed outside said taper-shaped member, each of said LED units having at least one LED chip having two electrodes electrically connected with said thermally conductive member said taper-shaped member respectively.

2. The LED illuminating device as defined in claim 1, wherein each of said LED units further comprises a lead wire and a packaging member, said LED chips being planted onto a surface of said thermally conductive member, one of said two electrodes of said at least one LED chip of each said LED units being electrically conducted with said thermally conductive member, and the other being electrically connected with said taper-shaped member via said wire, said packaging member encasing said lead wire and said LED chip.

3. The LED illuminating device as defined in claim 1, wherein each of said LED units further comprises an insulating thermally-conductive base planted onto a surface of said thermally conductive member, a packaging member encasing said LED chip and said insulating thermally-conductive base, and two electrically conductive pieces electrically connected with said two electrodes of said LED chip respectively, said LED chip being mounted to said insulating thermally-conductive base.

4. The LED illuminating device as defined in claim 2 or 3 further comprises a reflective cup sleeved onto said thermally conductive member, said reflective cup having a reflective surface located at an internal side thereof and corresponding to said LED units.

5. The LED illuminating device as defined in claim 4 further comprising a second insulating layer partially covering a midsection of said thermally conductive member; said taper-shaped member comprises an extension body surrounding said midsection of said thermally conductive member and sleeved onto said second insulating layer, said taper-shaped member and said extension body being spaced from said thermally conductive member by said first and second insulating layers; said through holes run through said extension body; said LED units are mounted to said taper-shaped portion and said midsection of said thermally conductive member, passing through said through holes and exposed outside said taper-shaped member and said extension body.

6. The LED illuminating device as defined in claim 5, wherein said thermally conductive member is a heat sink.

* * * * *